US006328776B1

(12) United States Patent
Shanks et al.

(10) Patent No.: US 6,328,776 B1
(45) Date of Patent: Dec. 11, 2001

(54) AIR-PURIFYING SYSTEM

(75) Inventors: Anthony E. Shanks; Patrick J. Monnens, both of Prior Lake; Richard R. Bahn, Loretto, all of MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 09/475,615

(22) Filed: Dec. 30, 1999

(51) Int. Cl.[7] ..... F24F 3/16
(52) U.S. Cl. ..... 55/385.2; 55/467; 454/232
(58) Field of Search ..... 55/385.2, 467, 55/470; 454/187, 228, 230, 232, 233, 236

(56) References Cited

U.S. PATENT DOCUMENTS

| | | | | |
|---|---|---|---|---|
| 3,458,130 | * | 7/1969 | Juhlin | 454/232 X |
| 3,977,467 | * | 8/1976 | Northrup, Jr. . | |
| 4,409,889 | * | 10/1983 | Nutlrdon | 55/385.2 X |
| 4,523,588 | | 6/1985 | Dolsky . | |
| 4,531,454 | * | 7/1985 | Spoormaker | 454/232 |
| 4,534,775 | | 8/1985 | Frazier . | |
| 4,955,997 | * | 9/1990 | Robertson, III | 55/385.2 X |
| 4,993,629 | * | 2/1991 | Wylie | 454/236 X |
| 5,097,674 | * | 3/1992 | Imaiida et al. | 454/236 X |
| 5,225,167 | * | 7/1993 | Wetzel | 454/228 X |
| 5,302,354 | | 4/1994 | Watvedt et al. . | |
| 5,336,128 | * | 8/1994 | Birdsong | 55/385.2 X |
| 5,348,563 | | 9/1994 | Davis . | |
| 5,562,286 | | 10/1996 | Brinket . | |
| 5,942,323 | | 8/1999 | England . | |
| 5,961,702 | | 10/1999 | Doneit . | |

OTHER PUBLICATIONS

United Air Specialties, Inc., Advertisement Brochure entitled, "Crystal–Aire Modular Air Cleaning Systems", © 1992, pp. 1–4.

* cited by examiner

*Primary Examiner*—Harold Joyce
(74) *Attorney, Agent, or Firm*—Dicke, Billig & Czaja, P.A.

(57) ABSTRACT

An air-purifying system for filtering and re-circulating room air. The air-purifying system includes a blower module, a first filter module, a second filter module and a supply module. The blower module defines a first inlet, a second inlet and an outlet. The first filter module is spaced from the blower module, and is fluidly connected to the first inlet. Similarly, the second filter module is spaced from the blower module and the first filter module. The second filter module is fluidly connected to the second inlet. Finally, the supply module is spaced from the blower module and the filter modules. The supply module is fluidly connected to the outlet. With this configuration, the blower module is operated to draw air into the first and second filter modules for removal of contaminants. Further, the blower module forces cleansed air to the supply module.

33 Claims, 5 Drawing Sheets

AIR-PURIFYING SYSTEM

BACKGROUND OF THE INVENTION

The present invention relates to a system for purifying room air. More particularly, it relates to a modular air-purifying system including separate, independently positionable blower, filter and supply modules.

In recent years, there has been a growing interest to improve environmental air conditions in homes and in commercial settings, such as offices, restaurants, taverns, bowling alleys, hospitals, laboratories, lavatories, and the like. As more information has been made available to the public concerning the hazards of indoor air pollution, there has been an increased demand for filtering devices that can be used to effectively improve air quality.

A self-contained, stand-alone air cleaning or filtration unit is normally employed to clean air in both residential and commercial settings. Stand-alone air cleaning units can assume a wide variety of forms, but generally include a housing maintaining one or more applicable filter materials and a fan or blower unit. The housing defines an inlet, at which the filter(s) is disposed, as well as an outlet or exhaust port. Most commercial applications include a false ceiling, such that the housing is readily "hidden" above the ceiling, with only the inlet (or an associated grille) being visible to persons within the room. During use, the fan or blower unit is operated to draw room air through the filter via the inlet. The filter material or media removes undesirable air-borne particles and/or gaseous contaminants/odors, such as dust, smoke, pollen, molds, volatile organic compounds (VOCs), etc. from the airflow. Following interaction with the filter material, the now "cleansed" air is forced, via the blower, back into the room through the outlet. A continuous intake and supply of air preferably generates a desired air re-circulation pattern within the room.

While the self-contained air filtration unit is well accepted, certain potential drawbacks have been identified. First, in an effort to optimize filtering performance, the stand-alone filtration unit is normally centrally located in (or over) the room of interest. Often times, one or more room occupants may work or otherwise be located in that same central area, directly below the air filtration unit. For example, a desk, chair, table, entertainment device, etc. may be positioned in the center of a room. For persons sitting, working or otherwise occupying this center area, the air-filtration unit may prove highly intrusive. Noise generated by blower motor operation can be distracting, making it difficult to concentrate, speak with others, etc. Similarly, forced air supplied from the air filtration unit's outlet may cause further room occupant discomfort. Second, for larger rooms, a single air cleaning unit may not provide adequate filter material surface area and/or two or more different areas of relatively heavy air pollution may exist within a single room. In either case, two or more air filtering units must be purchased and installed, thereby increasing overall costs. Simply stated, a single, self-contained air filtration unit cannot clean and re-circulate air in two, adjacent rooms. Even further, because the stand-alone unit does not have the ability to exhaust air outside the room, a negative pressure cannot be created, such that "fresh" air is not advantageously drawn into the room. An additional, albeit unrelated, concern arises during replacement of a filter. Because the filter is located directly adjacent the blower motor, the entire air filtration unit must be deactivated prior to filter replacement.

An alternative concept to the stand-alone filtration unit is a modular air-purification system. With this approach, a blower module and a filter module are separately provided and installed over a room of interest. Perhaps due to the wide acceptance of stand alone air filtration units, as well as the numerous engineering obstacles presented by a modular-configuration, only one modular-type air cleaning system has been identified, advertised as being available under the trade name Crystal-Aire® from United Air Specialties, Inc. of Cincinnati, Ohio. According to a trade brochure, this air-cleaning system includes separate blower and filter units designed to be connectable by a single duct. This configuration allows the blower unit to be installed apart from the filter unit. However, the blower unit has only one inlet port and one outlet port, such that the system is restricted to a single filter unit connected to the inlet port, and a single supply (or forced air return) unit connected to the outlet port. In theory, it may be possible to connect two or more filter units and/or supply units in series to the blower unit. Unfortunately, overall blower efficiency and recirculation may be greatly reduced.

Air-purifying systems are extremely popular and beneficial. However, the standard "self-contained" design is highly inflexible, and must be centrally located within a room of interest. As a result, the self-contained air-cleaning unit intrudes upon room occupants, leading to potential discomfort. Therefore, a need exists for a modular air-purifying system configured to optimize filtering and air re-circulation performance.

SUMMARY OF THE INVENTION

One aspect of the present invention relates to an air-purifying system. The system includes a blower module, a first filter module, second filter module and a supply module. The blower module defines a first inlet, a second inlet and an outlet. The first filter module is spaced from, and fluidly connected to, the blower module via the first inlet. The second filter module is spaced from the blower module and the first filter module, and is fluidly connected to the blower module via the second inlet. Further, the supply module is spaced from the blower module and the filter modules, and is fluidly connected to the blower module via the outlet. With this configuration, the blower module draws air into the first and second filters modules for removal of air-borne contaminants. Further, the blower module forces cleansed air to the supply module. By forming each of the modules separately, optimal positioning of each component relative to a room of interest can be achieved. For example, the blower module can be located such that any noise produced by the blower module has minimal, if any, affect on room occupants. Further, the filter modules and the supply module can be located to optimize system performance as well as to minimize potential occupant discomfort. In one preferred embodiment, the system includes four supply modules strategically positionable to achieve ideal air re-circulation within a room of interest.

Another aspect of the present invention relates to an air-purifying system. The system includes a blower module, first and second filter modules and a plurality of supply modules. The filter modules are fluidly connected to the blower module in parallel. Similarly, the supply modules are fluidly connected to the blower module in parallel. Each of the modules are spaced from one another. With this configuration, the blower module draws air into the filter modules for removal of air-borne contaminants and forces cleansed air to the supply modules. By connecting the filter modules and the supply modules, respectively, in parallel to the blower module, system efficiency and performance is maximized. Further, during use, the filter modules and the supply modules are positionable to optimize air filtration and re-circulation.

Yet another aspect of the present invention relates to an air-purifying system including a blower module, a filter module and a supply module. The blower module defines a pair of inlet ports and an outlet port. The filter module is spaced from the blower module and defines a pair of outlets. Each of the pair of outlets is fluidly connected to a respective one of the pair of inlet ports. The supply module is spaced from the blower module and the filter module, and is fluidly connected to the blower module via the outlet port. During use, the blower module operates to draw room air into the filter module for removal of air-borne contaminants. Further, the blower module forces "cleansed" air to the supply module.

Yet another aspect of the present invention relates to a method of purifying room air. The method includes providing a blower module. A first filter module is positioned apart from the blower module, and is fluidly connected to the blower module. Similarly, a second filter module is positioned apart from the blower module, and is fluidly connected to the blower module. In this regard, the first and second filter modules are connected in parallel to the blower module. A supply module is positioned apart from the blower module and the filter modules, and is fluidly connected to the blower module. Finally, the blower module is operated to draw room air into the filter modules to remove air-borne contaminants, and to force cleansed air to the supply module. In one preferred embodiment, a plurality of supply modules are fluidly connected, in parallel, to the blower module. In an even further preferred embodiment, the filter modules and the supply modules are positioned to filter and re-circulate air in separate rooms.

DESCRIPTION OF THE PREFERRED EMBODIMENTS

Figure 1:
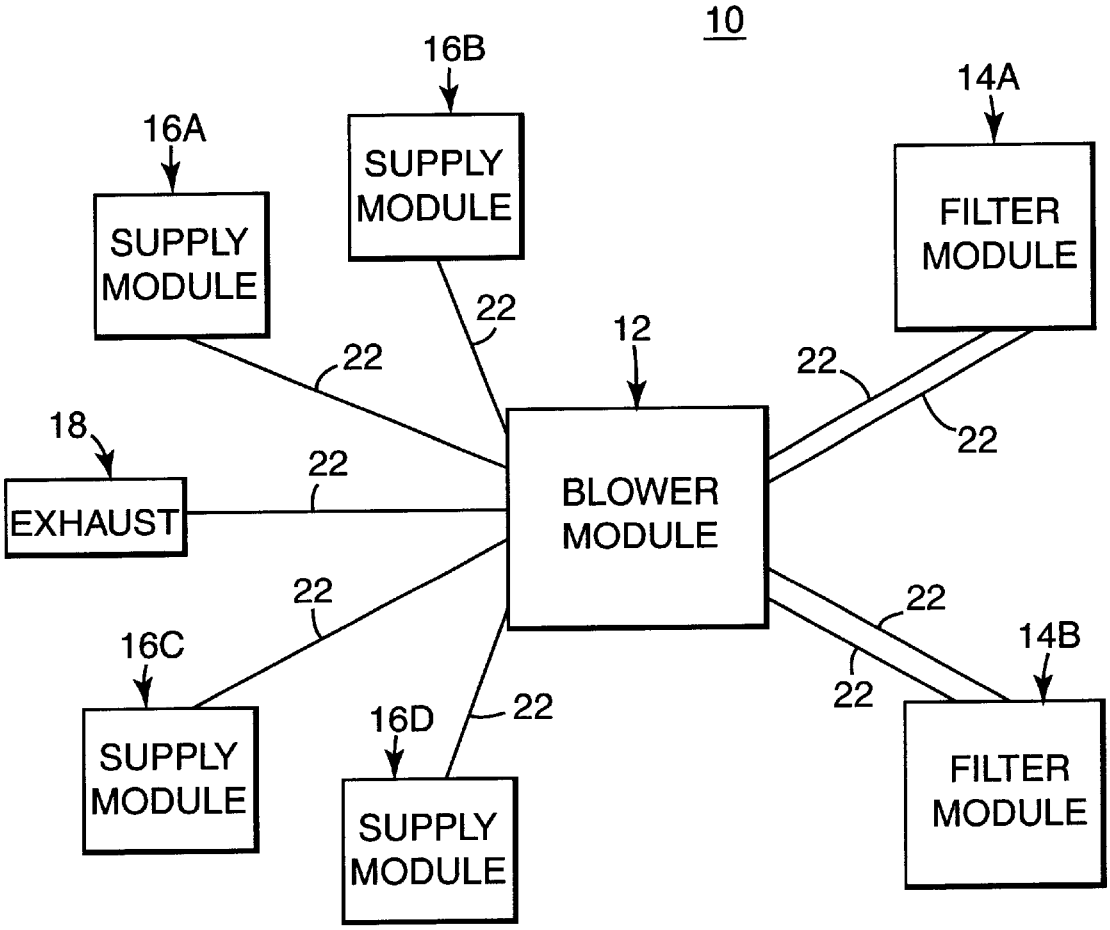
FIG. 1 is a schematic view of an air-purifying system in accordance with the present invention.

One preferred embodiment of an air-purifying system 10 in accordance with the present invention is shown schematically in FIG. 1. System 10 includes a blower module 12, filter modules 14A and 14B, supply modules 16A–16D, and an exhaust 18. Filter modules 14A, 14B, supply modules 16A–16D and exhaust 18 are fluidly connected to blower module 12 by ductwork 22. As described in greater detail below, filter modules 14A, 14B are separately connected to blower module 12 such that filter modules 14A, 14B are in parallel. Supply modules 16A–16D are similarly fluidly connected in parallel to blower module 12 via ductwork 22.

Figure 2A:
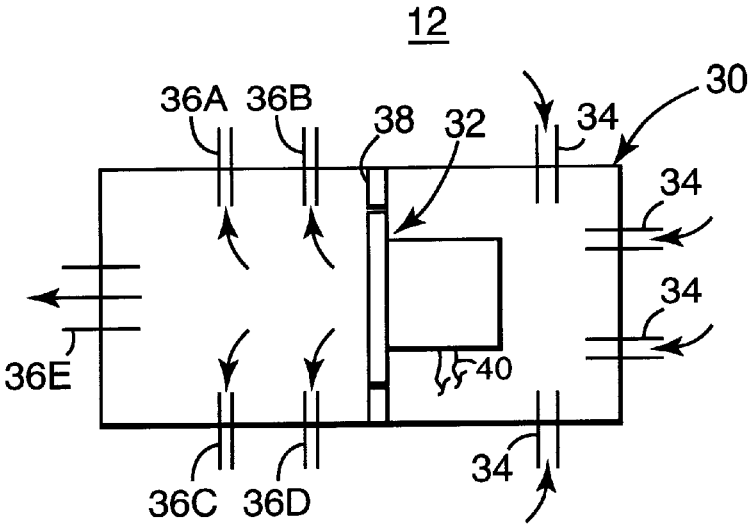
FIG. 2A is a schematic view of a blower module of the system of FIG. 1.

One preferred embodiment of blower module 12 is depicted schematically in FIG. 2A. In general terms, blower module 12 includes a housing 30 maintaining a blower unit or fan 32. Housing 30 is made of a rigid material, such as galvanized steel, aluminum or plastic, and is sized to encompass blower unit 32. Housing 30 further defines a plurality of inlets or inlet ports 34 and a plurality of outlets or outlet ports 36. Blower module 12 preferably further includes at least one plenum plate 38 disposed within housing 30, isolating inlet ports 34 from outlet ports 36 and establishing a necessary plenum chamber for proper operation of blower module 12, as known in the art.

Blower unit 32 can assume a wide variety of forms, and in one preferred embodiment is a ⅓ horsepower motorized blower. Other differently sized motors, offering either greater or less power, can be utilized. Even further, a plurality of blower units 32 can be provided. Additionally or alternatively, one or more fans, such as centrifugal fans, can be employed. Regardless, blower module 12 preferably further includes means for relaying electrical power to blower unit 32. Relaying means can include an electrical power input (not shown) configured to receive a plug of an extension cord or the like and may be plugged into an electrical outlet. Alternatively, blower unit 32 can be hard-wired to a separately available power source upon installation, such as by wiring 40.

Inlet ports 34 are formed along housing 30 so as to be upstream of blower unit 32. In one preferred embodiment, four inlet ports 34 are provided. With additional reference to the preferred embodiment of FIG. 1, two of inlet ports 34 correspond with, and are fluidly connectable to, filter module 14A. Similarly, another two of inlet ports 34 correspond with, and are fluidly connectable to, second filter module 14B. Alternatively, each of filter modules 14A, 14B can be configured for fluid connection to blower module 12 by a single duct, such that only two of inlet ports 34 are required. Regardless of exact number, blower module 12 is formed such that filter modules 14A, 14B are fluidly connectable to housing 30 in parallel. That is to say, housing 30 forms at least one inlet port 34 for each filter module.

With further reference to FIGS. 1 and 2A, in one preferred embodiment, housing 30 provides five outlet ports 36 (shown as outlet ports 36A–36E). Outlet ports 36A–36D correspond with supply modules 16A–16D, with each outlet port 36A–36D configured for connection to a respective one of supply modules 16A–16D. By providing separate outlet ports 36A–36D, supply modules 16A–16D are fluidly connectable to blower module 12 in parallel. Finally, outlet port 36E serves as an exhaust, corresponding with exhaust 18 of FIG. 1. While housing 30 has been preferably described as including five outlet ports 36, any other number, either greater or lesser, may be employed. For example, for certain applications, exhaust 18 may not be required, thereby eliminating exhaust port 36E. Alternatively, or in addition, system 10 may require as few as one supply module 16 (for example, supply module 16A of FIG. 1), such that only a single outlet port 36 is formed by housing 30.

Figure 2B:
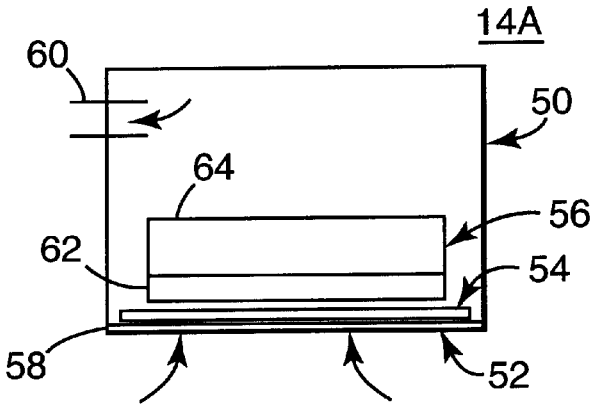
FIG. 2B is a schematic view of a filter module of the system of FIG. 1.

Similar to blower module 12, filter modules 14A, 14B can assume a wide variety of forms. One preferred embodiment of filter module 14A is shown in FIG. 2B. While not depicted, filter module 14B (FIG. 1) is preferably identically constructed. Filter module 14A is comprised generally of a housing 50, a grille 52, a pre-filter 54 and a filter assembly 56. As described in greater detail below, grille 52, pre-filter 54 and filter assembly 56 are maintained by housing 50.

Housing 50 is preferably constructed of a rigid material, such as steel, aluminum or hardened plastic, and forms air inlet 58 and two air outlets 60. Inlet 58 is sized to receive and maintain grille 52. Outlets 60 are configured to be fluidly connectable to blower module 12 (FIG. 1) by ductwork 22 (FIG. 1) as previously described. As shown by arrows in FIG. 2B, airflow passes from inlet 58 through grille 52, pre-filter 54 and filter assembly 56, and outwardly from housing 50 through outlets 60.

Grille 52 is sized to encompass inlet 58 of housing 50. Grille 52 is preferably an egg crate grille, formed from aluminum or hardened plastic, as known in the art. Grille 52 is provided to capture large, air-borne fibers, as well as to render filter module 14A aesthetically pleasing. Preferably, grille 52 is selectively detachable from housing 50.

Pre-filter 54 can assume a wide variety of forms as known in the art, and is preferably configured to retain relatively large air-borne particles. For example, pre-filter 54 can be a lightweight, low efficiency (on the order of 15% dust spot efficiency) impingement filter, such as open cell foam, cellulose, etc. In one preferred embodiment, pre-filter 54 is configured to be selectively detachable from housing 50.

Filter assembly 56 is sized for installation within housing 50 and preferably includes a primary particulate or fiber filter 62 and a sorbent material filter 64. In a preferred embodiment, primary particulate filter 62 and sorbent material filter 64 are coupled by a frame (not shown) configured for selective attachment and detachment to housing 50.

Primary particulate filter 62 is employed to remove fibers or particles, such as pollen, molds, bacteria, etc. Particulate filters are typically "rated" according to filtering efficiency and resistance to airflow. A well-known example of an acceptable primary particulate filter is a high efficiency particulate arrestance (HEPA) filter. HEPA are generally comprised of intertwined, small (less than 1 micron) glass fibers and have a minimum efficiency of 99.97% relative to 0.3 micron dioctyl phthalate (DOP) particles. Alternatively, primary particulate filter 62 can assume other forms/structures known in the art (with lower efficiencies), such as a 95% ASHRAE filter or cellulose, wool felt or glass fiber filters with efficiencies ranging from 30%–95% ASHRAE rated dust spot efficiency.

Sorbent material filter 64 also is well known in the art and provides enhanced filtering of gaseous contaminants and odors (e.g., tobacco smoke odors, cooking odors, volatile organic compounds (VOCs), etc.). Sorbent material filters typically include a relatively large volume of an appropriate sorbent material, or a combination of sorbent materials, in either granular or impregnated form. The sorbent material adsorbs gaseous contaminants and odors, thereby removing the contaminants from the air stream. Sorbent materials identified as being most effective in removing odors include charcoal or carbon, potassium permanganate and zeolite. In fact, an extremely popular sorbent material is available under the trade name CPZ™, generally composed of 60% charcoal or carbon, 20% potassium permanganate and 20% zeolite. As a point of reference and in a preferred embodiment, sorbent material filter 64 includes approximately 5–18 pounds, most preferably 10 pounds of CPZ™ material for long-term odor filtration of a 2000–5000 cubic foot room or region. Regardless, the sorbent material is normally disposed within an encasement, such as a rigid frame or bag that may or may not be attached to primary particulate filter 62.

While filter module 14B (FIG. 1) is preferably identical to filter module 14A, other configurations are equally acceptable. For example, filter module 14A can include primary particulate filter 62, whereas filter module 14B includes sorbent filter 64. Further, filter modules 14A and 14B can be differently shaped and/or sized.

Figure 2C:
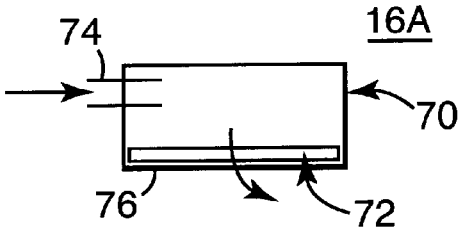
FIG. 2C is a schematic view of a supply module of FIG. 1.

Supply module 16A is shown in greater detail in FIG. 2C. Although not depicted, in a preferred embodiment, supply modules 16B–16D (FIG. 1) are identically constructed. Supply module 16A can assume a wide variety of forms (e.g., shape, size and construction), and preferably includes a housing 70 and a faceplate or grille 72. Housing 70 defines an air inlet 74 and an air outlet 76. Air inlet 74 is configured to be fluidly connected to blower module 12 (FIG. 1) by ductwork 22 as previously described. Outlet 76 is sized to receive and maintain grille 72. With this configuration, airflow enters supply module 16A at air inlet 74 and exits at air outlet 76, passing through grille 72. Grille 72 is preferably a louvered grille such that a direction of airflow from supply module 16A can be dictated by user preference. Alternatively, grille 72 can be an egg crate known in the art.

Returning to FIG. 1, and as previously described, air purifying system 10 of the present invention can vary greatly in terms of number and construction of filter modules 14A, 14B, supply module 16A–16D, and exhaust 18. Where desired, exhaust 18 can be an open end of respective ductwork 22, or can include a separate module, similar for example, to supply module 14A previously described.

Finally, ductwork 22 is preferably flexible ducts as known in the art. Each of filter modules 14A, 14B, supply modules 16A–16D, and exhaust 18 is fluidly connected to blower module 12 by at least one flexible duct. In a preferred embodiment, each of filter modules 14A, 14B are fluidly connected to blower module 12 with a pair of ducts 22. Depending upon the constraints presented by a particular installation, each of the flexible ducts can have a different length, ranging from a few feet to as much as 100 feet.

Figure 3A:
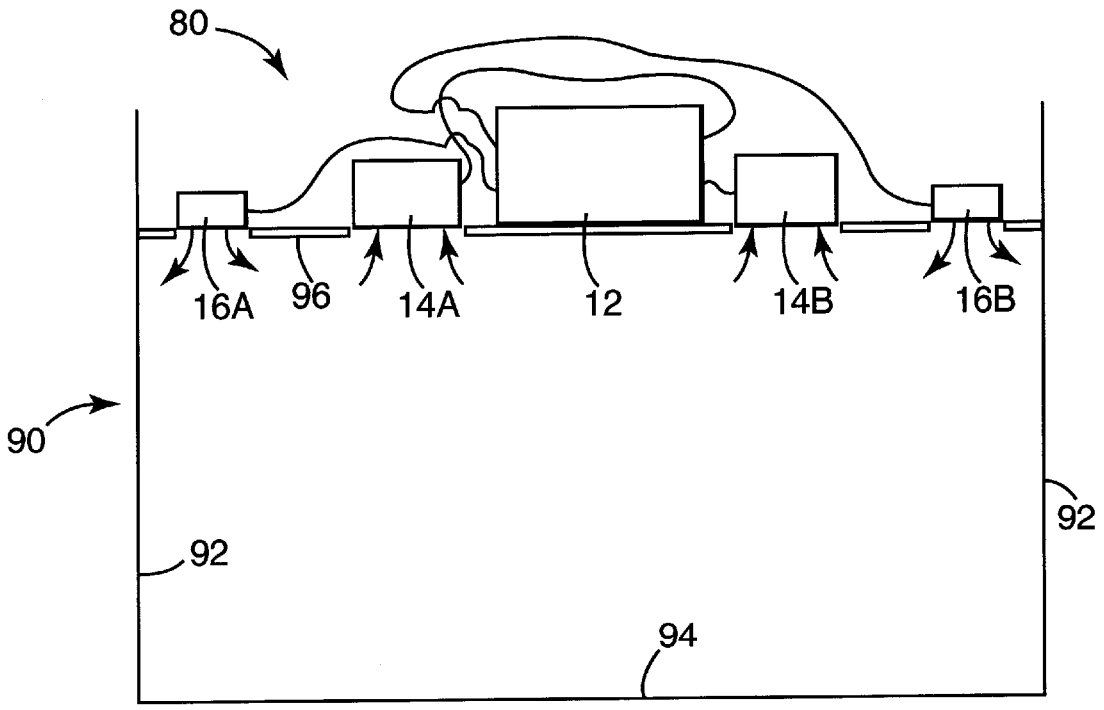
FIG. 3A is a side, schematic view of an air-purifying system in accordance with the present invention installed to a room.
Figure 3B:
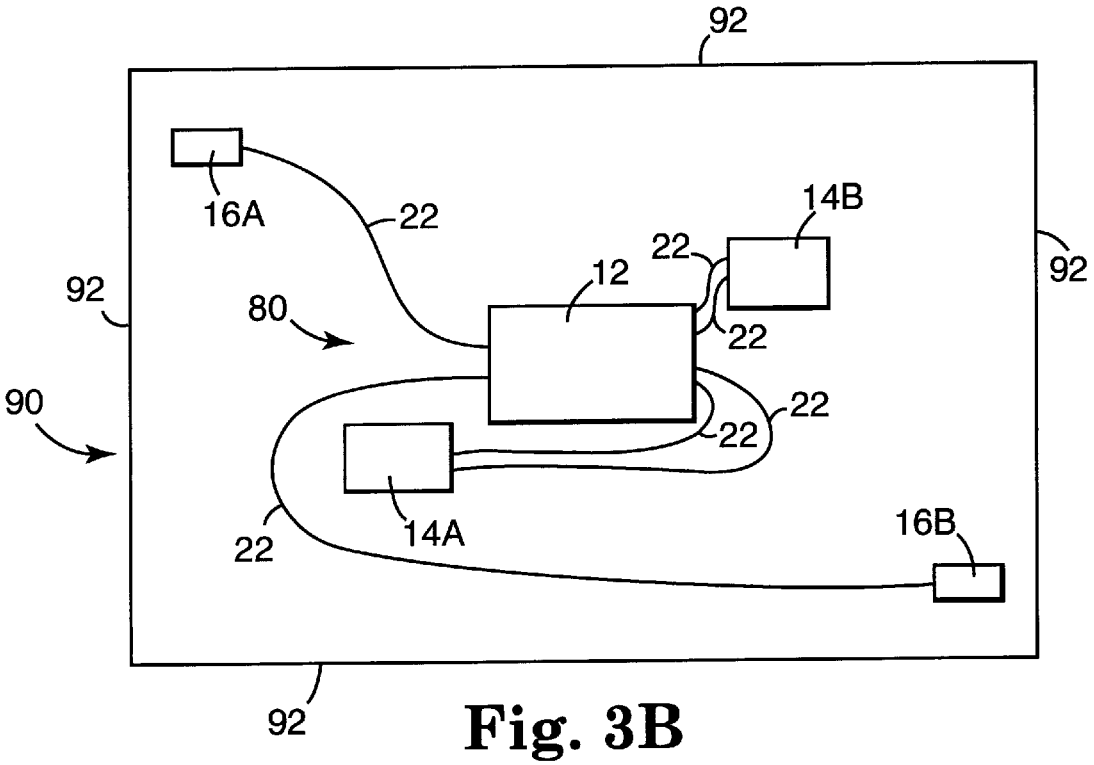
FIG. 3B is a top, schematic view of the installation of FIG. 3A.

During installation, air-purifying system 10 can be configured and modified to satisfy the needs of any area (or room) requiring air filtration or cleansing. One example of an alternative air-purifying system 80 applied to a room 90 is shown in FIGS. 3A and 3B. As a point of reference, room 90 is generally defined by walls 92, a floor 94 (shown best in FIG. 3A) and a ceiling 96. In most commercial settings, ceiling 96 is a "false" ceiling, comprised of a number of removable ceiling panels (not shown). With this configuration, various components of air-purifying system 10 can be installed and effectively hidden above ceiling 96, with certain of the ceiling panels removed to allow airflow into the filter modules and out of the supply modules. Alternatively, where ceiling 96 is a more "permanent" structure, air-purifying system 80 is installed to, and extends downwardly from, ceiling 96.

With the above definitions of room 90 in mind, air-purifying system 80 is shown in FIGS. 3A and 3B as including blower module 12, filter modules 14A, 14B and supply modules 16A, 16B. In the example of FIGS. 3A and 3B, supply modules 16C, 16D (FIG. 1), and exhaust 18 (FIG. 1) associated with air-purifying system 10 (FIG. 1) are not provided. As shown best in FIG. 3B, each of filter modules 14A, 14B and supply modules 16A, 16B are spaced from blower module 12. In particular, filter modules 14A, 14B are disposed over opposing regions of room 90. With this configuration, a more complete filtering of air within room 90 can be achieved. Similarly, supply modules 16A, 16B are disposed over opposing regions of room 90. By locating supply modules 16A, 16B adjacent opposing corners of room 90, a more complete air recirculation within room 90 can be achieved. Once properly positioned, each of filter modules 14A, 14B and supply modules 16A, 16B are fluidly connected in parallel, to blower module 12 by ductwork 22.

During use, and as shown by arrows in FIG. 3A, blower module 12 is operated to draw air into filter modules 14A, 14B. Filter modules 14A, 14B, each include at least one filter (as previously described), which acts to remove particulates and/or odors from the room air. Blower module 12 further forces the "cleansed" air back into room 90 via supply module 16A, 16B. Because filter modules 14A, 14B and supply modules 16A, 16B are separable from, but remain fluidly connected to, blower module 12, an optimal air filtration and re-circulation within room 90 can be achieved.

Figure 4A:
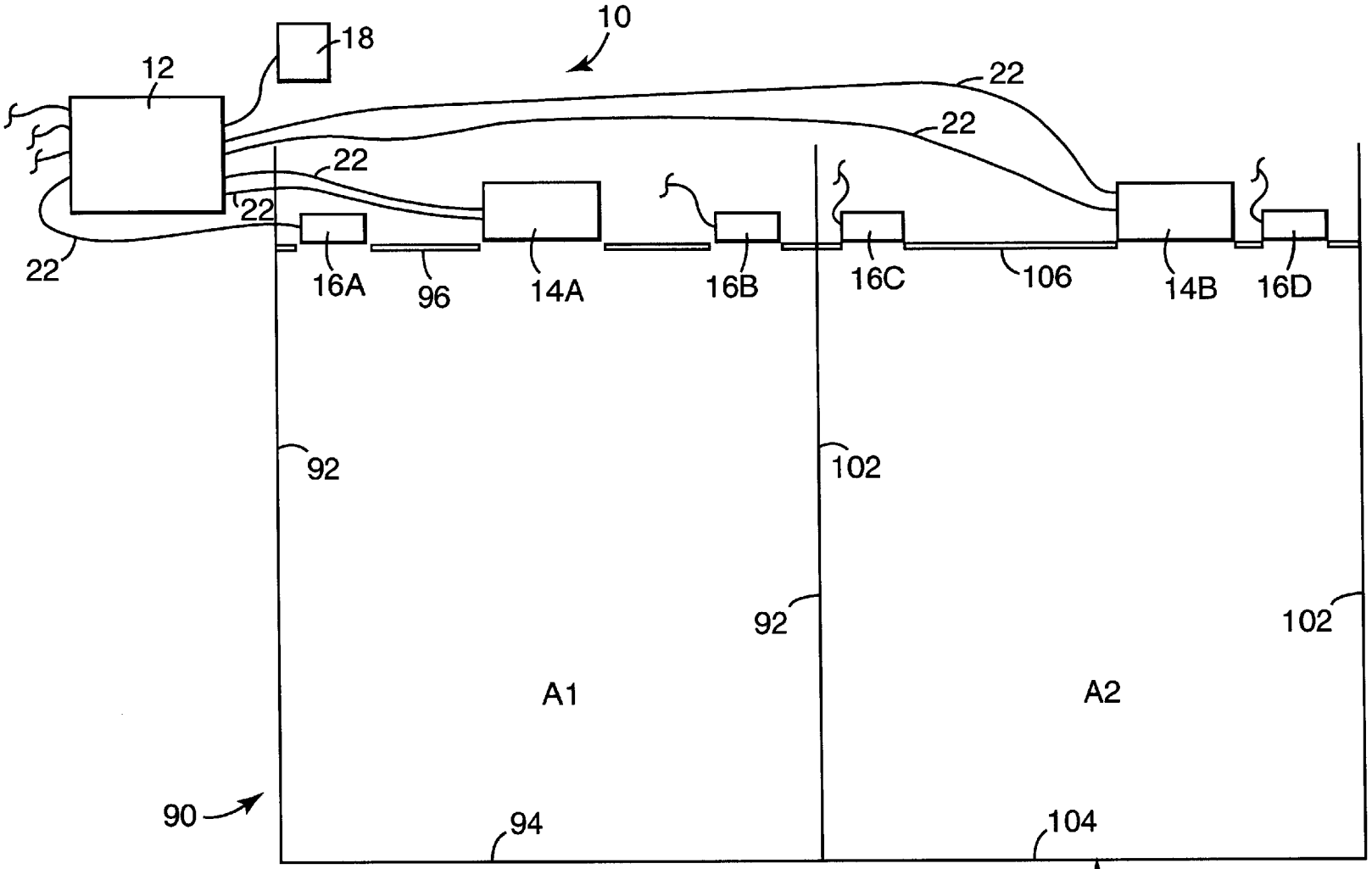
FIG. 4A is a side, schematic view of an air-purifying system in accordance with the present invention installed to two rooms.
Figure 4B:
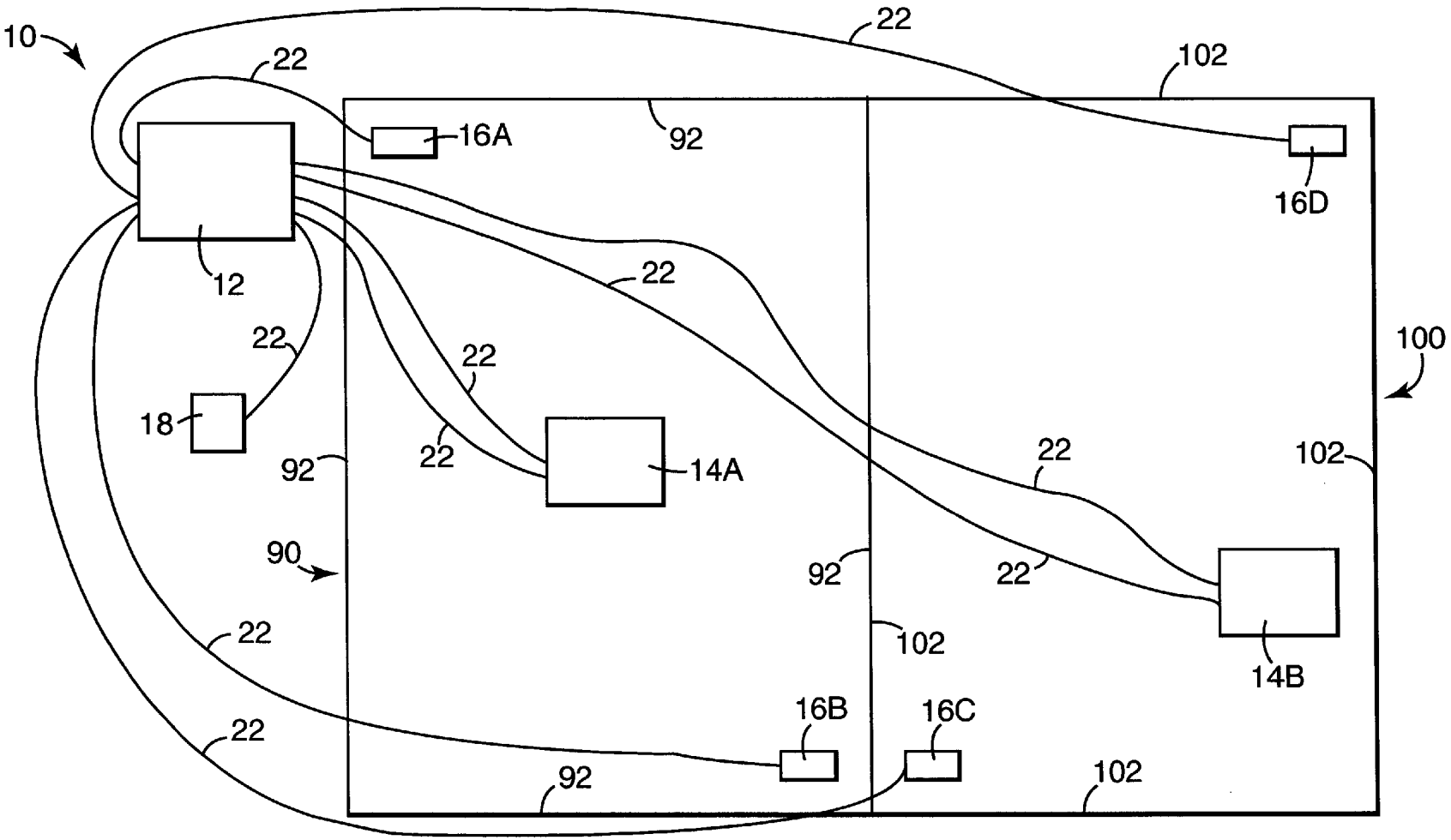
FIG. 4B is a top, schematic view of the installation of FIG. 4A.

In addition to optimizing airflow filtration and circulation, air-purifying system 10 of the present invention can further be configured to clean air of more than one room as shown, for example, in FIGS. 4A and 4B. As a point of reference, FIGS. 4A and 4B depict air-purifying system 10 in conjunction with two separate rooms, including room 90 (as previously described) and room 100. Similar to room 90, room 100 includes walls 102, a floor 104 and a ceiling 106. Once again, ceiling 106 may be a "false" ceiling or maybe a more permanent structure. Regardless, air-purifying system 10 is configured and installed to rooms 90, 100 by positioning filter module 14A to (or over) room 90 and filter module 14B to (or over) room 100. Further, supply modules 16A, 16B are positioned to (or over) room 90; whereas supply modules 16C, 16D are positioned to (or over) room 100. For ease of illustration, ductwork 22 for supply modules 16–16D has been shown partially. Air-purifying system 10 is able to filter and re-circulate air within two, separate rooms 90, 100 with only a single blower module 12. This is in direct contrast to "standard" stand-alone filtering units that would otherwise require two separate units to filter and recirculate air within two different rooms 90, 100. Further, air-purifying system 10 includes exhaust 18 extending away from rooms 90, 100. With this configuration, a negative pressure can be created in rooms 90 and/or 100. By generating a negative pressure, fresh air is drawn into rooms 90 and/or 100. Once again, this attribute cannot be achieved with a stand-alone filtering unit.

An additional feature of air-purifying system 10 is an ability to minimize possible intrusions on occupants of rooms 90 and/or 100. In this regard, prior to installing air-purifying system 10 an analysis can be made to ascertain a region of main activity in rooms 90, 100 (designated by A1 in room 90 and A2 in room 100). For example, room 90 and/or 100 may be an office having a region A1 or A2, respectively, including a desk at which an occupant of room 90 and/or 100 sits. Alternatively, room 90 and/or 100 may be a lunchroom, a smoking area, restaurant, etc. which includes one or more tables in region A1 or A2, respectively. It will be understood that occupants of room 90 and/or 100 will spend a majority of their time at this table (and therefore region A1 or A2, respectively). With this analysis in mind, components of air-purifying system 10 can be located to avoid occupant discomfort while still achieving highly satisfactory air filtering and re-circulation.

For example, it is recognized that blower module 12 may generate an obtrusive noise during use. So as to minimize the impact of this noise upon occupants of rooms 90, 100, blower module 12 is preferably installed away from rooms 90, 100 as shown in FIGS. 4A and 4B. Alternatively, where areas surrounding rooms 90 are not amenable to blower module 12 installation or where operation of air-purifying system 10 requires blower module 12 to be relatively close to filter modules 14A, 14B, blower module 12 may alternatively be installed above either room 90 or room 100. With this configuration, a preferred placement of blower module 12 is based upon a determination of regions of main activity A1 or A2. In particular, blower module 12 is located over either room 90 or room 100 away from region of main activity A1 or A2, respectively, so as to minimize noise impact upon room occupants.

Filter modules 14A, 14B can similarly be positioned over rooms 90, 100, respectively, so as to optimize air filtration. For example, filter module 14A is centrally located over room 90. With this central location, air from all areas of room 90 is relatively uniformly drawn into filter module 14A. Alternatively, filter module 14B is positioned relative to room 100 over region of main activity A2. In this regard, region of main activity A2 of room 100 may be a table or tables designated for smokers. As a result, a majority of air-borne particles and odors will be focused at region of main activity A2. Therefore, optimal room air filtration can be effectuated by positioning filter module 14B substantially directly over region of central activity A2 relative to room 100. Upon a reconfiguration of room 90 and/or 100, filter modules 14A or 14B can be repositioned to accommodate revised room requirements without requiring movement of blower module 12. Instead, filter module 14A or 14B can simply be relocated and connected to blower module 12 by ductwork 22.

Supply modules 16A–16D can similarly be located relative to rooms 90, 100, respectively, so as to achieve optimal air re-circulation while minimizing room occupant discomfort. For example, supply modules 16A, 16B are positioned at opposite corners of room 90. With this configuration, air re-circulation provided by supply module 16A, 16B is relatively evenly dispersed within room 90, thereby optimizing overall system 10 performance. In addition, location of the supply module(s) can further be based upon a determination of region of main activity A2, as with room 100. Region of main activity A2 of room 100 is substantially adjacent one of walls 102. For example, region of main activity A2 may be a desk at which a room occupant sits. With this in mind, supply modules 16C, 16D are positioned at opposite sides of room 100, away from region of main activity A2. With this preferred location, forced air exiting supply module 16C, 16D will not be directed at region of main activity A2. Thus, persons stationed within region of main activity A2 will not be subjected to a stream of forced air that might otherwise cause occupant discomfort.

As should be evident from the above, air-purifying system 10 can be configured in a number of different fashions depending upon the needs of a particular application. In this regard, the number and location of filter modules 14A, 14B and supply modules 16A–16D can be varied greatly. For example, the system 10 may be installed to a relatively large room with filter modules 14A, 14B and supply modules 16A–16D being strategically positioned to optimize effectiveness while minimizing intrusions. However, by fluidly connecting at least two filter modules 14A, 14B in parallel to the blower module 12, system performance is optimized. By way of example, an air-purifying system was constructed in accordance with that shown in FIG. 1 (as air-purifying system 10). Blower module 12 included a ⅓ horsepower motor, and filter modules 14A, 14B each included both a primary particulate filter and a sorbent material filter. With this configuration, operation of blower module 12 at approximately 1600 RPM generated a volumetric airflow rate in the range of 400–800 cubic feet per minute (CFM); most preferably 575 CFM for each of filter modules 14A, 14B. Additionally, an airflow rate of in the range of 100–320 CFM; most preferably 230 CFM was achieved for each of supply modules 16A–16D and exhaust 18. From this example, it can be seen that an air-purifying system in accordance with the present invention is able to achieve a volumetric airflow rate ratio between filter module and supply module of approximately 5:2 under optimal conditions, it being understood that a reduced ratio (e.g., 4:2) will be observed at certain times during use. Alternatively, other volumetric airflow ratios are equally acceptable.

One additional advantage of air-purifying system 10 is the ease with which a filter associated with filter module 14A or 14B can be replaced. Unlike self-contained, stand-alone units, the filter of filter module 14A or 14B can be replaced without deactivating blower module 12. In other words, because the potential hazards associated with the motor of blower module 12 are isolated from filter module 14A or 14B, it is not necessary to deactivate blower module 12. Instead, while blower module 12 is operating, the filter associated with filter module 14A or 14B can be removed and replaced.

The air-purifying system of the present invention provides a marked improvement over previous designs. By providing the blower module, filter modules and at least one supply module as separate components, each device can be located relative to a room of interest at desired locations. As a result, highly-effective air filtration and re-circulation can be achieved. Where a sorbent material is included with the filter modules, the air-purifying system is particularly suitable for removing odors from a designated smoking area on a highly cost-effective basis. Even further, the various modules can be strategically positioned to minimize noise and airflow intrusions on room occupants. Additionally, the air-purifying system of the present invention can be utilized to purify and re-circulate air in two or more rooms with a single system. Finally, by providing separate blower and filter modules, filter replacement can be effectuated without requiring system shutdown.

Although the present invention has been described with reference to preferred embodiments, changes can be made in form and detail without departing from the spirit and scope of the present invention. For example, the air-purifying system has been described as preferably including two filter modules. Alternatively, three or more filter modules can be employed. Further, the filter modules need only include a single filter material as opposed to a combination of pre-filter, primary particulate and sorbent filter medias. Even further, the various schematic drawings have illustrated a preferred, box-like shape for each of the various modules. Other shapes, either regular or irregular, are equally acceptable. Additionally, other air handling equipment, such as VAV or HVAC, can be fluidly connected to the blower module.

What is claimed is:

1. An air-purifying system comprising:

a modular blower module including a blower unit and a housing defining a first inlet, a second inlet and a first outlet;

a first filter module spaced from said blower module, said first filter module being fluidly connected to said first inlet by first ductwork;

a second filter module spaced from said blower module and said first filter module, said second filter module being fluidly connected to said second inlet by second ductwork separate from said first ductwork; and a first supply module spaced from said blower module and said filter modules, said first supply module being fluidly connected to said first outlet and positioned over a room;

wherein said blower module draws air into said first and second filter modules for removal of air-borne contaminants and forces cleansed air to said supply module.

2. The system of claim 1, wherein said air-purifying system is configured such that said first and second filter modules are positionable over opposing regions of a room.

3. The system of claim 1, wherein said air-purifying system is configured such that said first filter module is positionable over a first room for cleaning air in said first room and said second filter module is positionable over a second room for cleaning air in said second room, said first room being separate from said second room.

4. The system of claim 1, wherein said blower module housing further defines a second outlet, said system further comprising:

a second supply module spaced from said blower module, said filter modules and said first supply module, said second supply module being fluidly connected to said second outlet.

5. The system of claim 4, wherein said air-purifying system is configured such that said first and second supply modules are positionable over opposing regions of a room for creating an air circulation pattern in said room.

6. The system of claim 4, wherein said air-purifying system is configured such that said first supply module is positionable over a first room for supplying air to said first room and said second supply module is positionable over a second room for supplying air to said second room, said first room being separate from said second room.

7. The system of claim 1, wherein said blower module housing defines a plurality of outlets, and wherein said system further includes at least four, spaced supply modules, each of said supply modules being fluidly connected to only a respective one of said plurality of outlets.

8. The system of claim 7, wherein air-purifying system is configured such that said first filter module and two of said supply modules are selectively positionable over a first room for cleansing and re-circulating air in said first room, and said second filter module and other two of said supply modules are selectively positionable over a second room for cleansing and re-circulating air in said second room, said first room being separate from said second room.

9. The system of claim 1, wherein said blower module housing further defines an exhaust port for exhausting air apart from said first supply module.

10. The system of claim 1, wherein said blower module housing defines four inlets, said first filter module being fluidly connected to a first pair of said inlets and said second filter module being fluidly connected to a second pair of said inlets.

11. The system of claim 1, wherein said first and second filter modules each include a sorbent material filter.

12. An air-purifying system comprising:

a modular blower module;

first and second filter modules fluidly connected to said blower module in parallel; and a plurality of supply modules fluidly connected to said blower module in parallel, at least one of said supply modules positioned over a room;

wherein said modules are spaced from one another, and further wherein said blower module draws air into said filter modules for removal of air-borne contaminants and forces cleansed air to said supply modules.

13. The system of claim 12, wherein said air-purifying system is configured for use in cleansing air of a room having a region of main activity, said blower module being selectively positionable over said room spaced from said region of main activity.

14. The system of claim 13, wherein said supply modules are configured to be positionable over said room spaced from said region of main activity.

15. The system of claim 12, wherein said air-purifying system is configured for cleansing air of a room, said filter modules configured to be selectively positionable over opposing regions, respectively, of said room for optimizing cleansing of air in said room.

16. The system of claim 15, wherein said supply modules are configured to be positionable over opposing regions of said room for optimizing air circulation.

17. The system of claim 12, wherein said air-purifying system is configured for use in cleansing air of a first room and a second room, said first filter module being selectively positionable over said first room for cleansing air of said first room, and said second filter module being selectively positionable over said second room for cleansing air of said second room.

18. The system of claim 17, wherein at least two of said supply modules are positionable over said first room for supplying cleansed air to said first room, and at least another two of said supply modules are positionable over said second room for supplying cleansed air to said second room.

19. The system of claim 12, wherein said air-purifying system includes four of said supply modules.

20. The system of claim 19, wherein said air-purifying system is configured such that an optimal volumetric airflow ratio of each of said filter modules to each of said supply modules is approximately 5:2.

21. The system of claim 12, wherein said blower module further defines an exhaust port for exhausting air apart from said supply modules.

22. The system of claim 12, wherein said first filter module is fluidly connected to said blower module by two ducts.

23. An air-purifying system comprising:

a modular blower module defining a first pair of inlet ports, a second pair of inlet ports and an outlet port;

a first filter module spaced from said blower module, said first filter module defining a pair of outlets, each of said pair of outlets being fluidly connected to a respective one of said first pair of inlet ports;

a second filter module spaced from said blower module and said first filter module, said second filter module defining a pair of outlets each fluidly connected to a respective one of said second pair of inlet ports; and a first supply module spaced from said blower module and said first filter module, said first supply module being fluidly connected to said outlet port and positioned over a room;

wherein said blower module draws air into said first filter module for removal of air-borne contaminants and forces cleansed air to said supply module.

24. The system of claim 23, wherein said blower module defines a plurality of outlet ports, the system further comprising:

a plurality of supply modules, each of said plurality of supply modules being fluidly connected to a respective one of said plurality of outlet ports.

25. A method of purifying room air, the method comprising:

providing a modular blower module;

selectively positioning a first filter module apart from said blower module;

fluidly connecting said first filter module to said blower module;

selectively positioning a second filter module apart from said blower module;

fluidly connecting said second filter module to said blower module in parallel with said first filter module;

positioning a supply module over a room and apart from said blower module;

fluidly connecting said supply module to said blower module; and operating said blower module to draw room air into said filter modules and force cleansed air to said supply module.

26. The method of claim 25, further comprising:

positioning a plurality of supply modules apart from said blower module; and fluidly connecting said plurality of supply modules in parallel to said blower module.

27. The method of claim 25, wherein the method further comprises identifying a region of main activity of a room, and wherein providing a blower module comprises:

locating said blower module away from said region of main activity.

28. The method of claim 25, wherein said first and second filter modules are positioned over opposing regions of a room.

29. The method of claim 28, further comprising:

positioning a plurality of supply modules over opposing regions of said room; and fluidly connecting said plurality of supply modules to said blower module.

30. The method of claim 25, wherein positioning said first filter module includes locating said first filter module over a first room, and wherein positioning said second filter module includes locating said second filter module over a second room.

31. The method of claim 30, further comprising:

positioning a first pair of supply modules over said first room;

fluidly connecting said first pair of supply modules to said blower module in parallel;

positioning a second pair of supply modules over said second room; and fluidly connecting said second pair of supply modules to said blower module in parallel.

32. The method of claim 25, wherein said first filter module includes a removable filter assembly, the method further comprising:

replacing said filter assembly while operating said blower module.

33. The method of claim 25, further comprising:

repositioning said first filter module relative to the blower module.

* * * * *